United States Patent [19]

Ralph

[11] Patent Number: 4,611,452

[45] Date of Patent: Sep. 16, 1986

[54] TAPE SEALED SURFACE LAYER FOR DOOR CONSTRUCTION

[75] Inventor: James L. Ralph, Shoreview, Minn.

[73] Assignee: Cole Sewell Corporation, St. Paul, Minn.

[21] Appl. No.: 792,298

[22] Filed: Oct. 28, 1985

[51] Int. Cl.[4] ..... E06B 3/70

[52] U.S. Cl. ..... 52/455; 52/785; 52/823

[58] Field of Search ..... 52/823, 826, 785, 809, 52/455, 457, 458

[56] References Cited

U.S. PATENT DOCUMENTS

| | | | |
|---|---|---|---|
| 893,131 | 7/1908 | Bogenberger | 52/458 |
| 2,797,450 | 7/1957 | Ropella | 20/35 |
| 2,822,870 | 2/1958 | Haynes | 160/380 |
| 3,590,540 | 7/1971 | Johnson | 52/309 |

*Primary Examiner*—Carl D. Friedman

*Attorney, Agent, or Firm*—Leo Gregory

[57] ABSTRACT

An outside door structure having a core and having an exterior or surface layer comprising a plurality of pieces sealed together at their abutting edges to provide a weather sealed exterior surface.

4 Claims, 6 Drawing Figures

TAPE SEALED SURFACE LAYER FOR DOOR CONSTRUCTION

BACKGROUND OF THE INVENTION

1. Field of the Invention

This invention relates to a combination door structure having an outer or surface formed of a layer of material.

2. Description of the Prior Art

The structure herein is particularly related to what are characterized as combination doors which are exterior doors and are exposed to the weather.

Combination doors are commonly formed having a unitary core and an exterior skin surface commonly formed of a single piece of sheet material overlying the front and back sides of the door surface.

Combination doors for the most part have cut-out central portions for the insertion of screen or window members. The cut-out portions of surface layers of such doors generally become waste material and such pieces are of such size as to be reduced to pieces which pieced together would be sufficient to form a cover layer for an outside surface of a door.

It would be desirable to assemble pieces of material to form a surface layer and have the same as impervious to weather as if made of a single sheet of material.

SUMMARY OF THE INVENTION

It is a purpose of this invention in connection with combination doors to make it practical to utilize for forming a surface layer or an outer skin for a door, the otherwise generally wasted cut-out portions of such doors.

More specifically it is an object of this invention in connection with a combination door having an outer skin overlying a core and having a window opening therein, to form said outer skin of a plurality of pieces fitted together, the pieces being secured are sealed together to form a unitary layer and the seams formed whereby all abutted edges are made to become weather sealed.

These and other objects and advantages of the invention will be set forth in the following description made in connection with the accompanying drawings in which like reference characters refer to similar parts throughout the several views.

DESCRIPTION OF A PREFERRED EMBODIMENT

Figure 3:
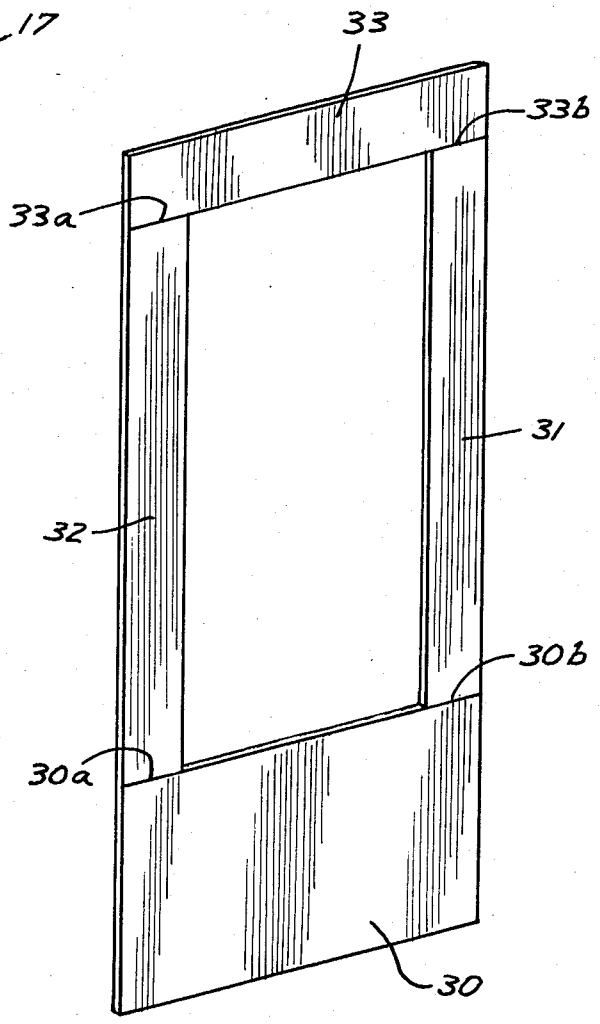
FIG. 3 is a view similar to that of FIG. 2 showing the outer side thereof.
Figure 1:
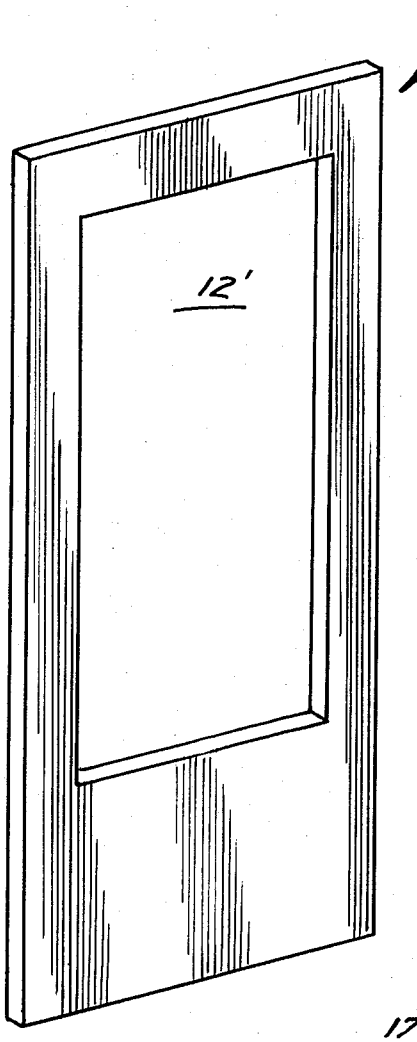
FIG. 1 is a view in perspective showing a solid door core.

Referring to the drawings, a combination storm and screen door structure is shown in FIG. 3 indicated by the reference numeral 10. Said door is shown to have a central cut-out or opening 12 for window or screen insertion. The inner core structure of member of said door is indicated by the reference numeral 14 in FIG. 1 and has an opening 12' therein. Said core is of conventional construction as of particle board.

Figure 6:
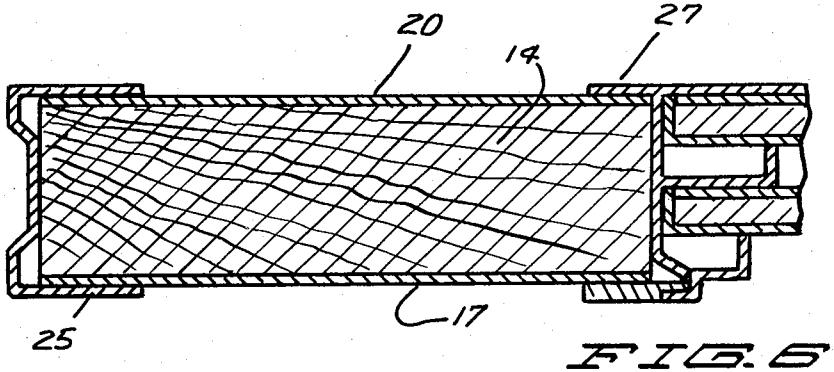
FIG. 6 is a view in horizontal section taken on line 6—6 of FIG. 4 as indicated.
Figure 5:
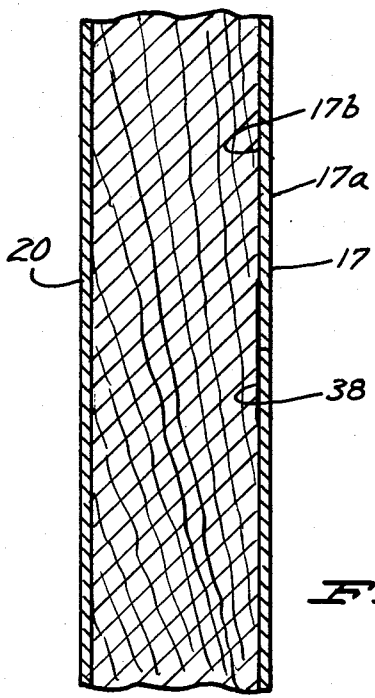
FIG. 5 is a view in vertical section taken in line 5—5 of FIG. 4 as indicated.

With reference to FIG. 5., said core 14 is indicated having surface of skin layer members 17 and 20 at each outer side thereof, the same being retained by peripheral channel strip members 25 and 27 as shown in FIG. 6.

Figure 2:
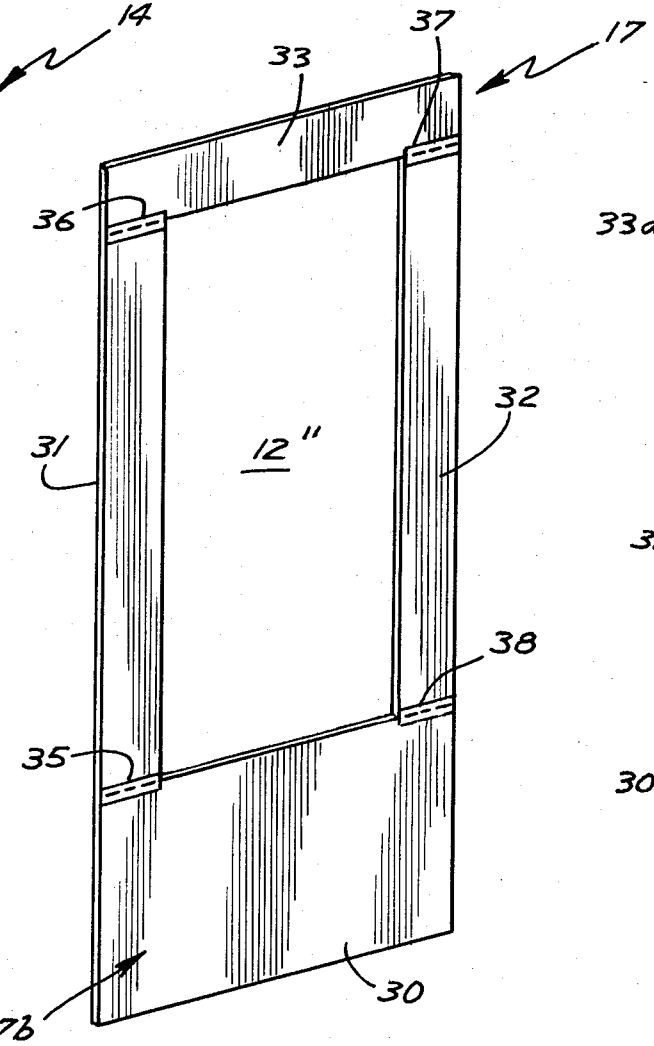
FIG. 2 is a view in perspective showing the underside of an outer skin or surface layer which is applied to a door core and showing the invention herein.

The surface layer member 17 is shown in FIG. 2 having a cut-out or opening 12'' therein. All of said openings correspond.

Said surface layer member 17 which embodies the invention herein, is positioned in FIG. 2 to show its inward or underside **17*b*. Said member 17, for purpose of illustration, is shown formed of four pieces, namely, a base plate 30, side strips 31 and 32 and a top plate member 33**.

As shown in FIG. 3, the abutting edges of the strips 31 and 32 and the plate member 33 are indicated in dotted line at **33*a* and 33*b* and the abutting edges of said strips and the base panel 30 are indicated in dotted line at 30*a* and 30*b***. Said abutting edges represent the seams between said pieces and hence, the terms edges and seams are to be considered to be interchangeable.

Figure 4:
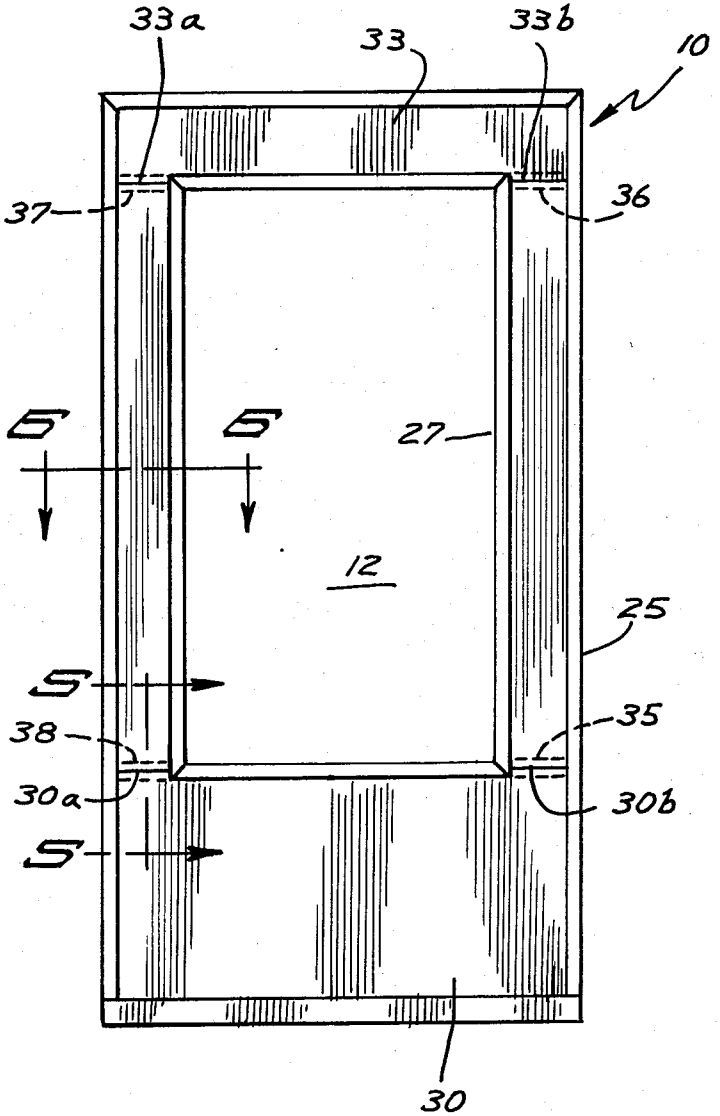
FIG. 4 is a view in front elevation of an assembled door structure.

Referring again to FIG. 2, said seams are shown to be overlaid with tape strips 35–38. It is essential that said seams be made to be weather sealed. These are conventional polyester film self-adhesive tape strips which will adhere to aluminum and other metals in tight sealing engagement and have such strength as to hold pieces together to make in effect an integral member. Said tape strips applied as shown in FIG. 2 and in FIG. 4 hold the pieces 30–33 securely positioned as shown and in being properly applied to sufficiently overlap, said tape strips cause the seams to be effectively weather sealed against penetration by weather elements.

FIG. 5 shows the tape strip 38 secure at the underside of the skin member 17 and pressed against the adjacent surface of the underlying side of the core member.

Thus, in effect, it is as if the layer member 17 were cut out of a single sheet of material. Thus economy and conservation are realized in utilizing pieces of material which might well otherwise be discarded as scrap material.

The outer of skin layer of each side of a combination door may be formed as above described or if it is desired to have a seamless front outerside of such a door, the inner side surface member may be formed as above described.

The structure herein above described has proved to be very satisfactory and successful.

It will of course be understood that various changes may be made in form, details, arrangement, and proportions of the parts without departing from the scope of the invention herein which, generally stated, consists in an apparatus capable of carrying out the objects above set forth, in the parts and combinations of parts disclosed and defined in the appended claims.

What is claimed is:

1. In connection with a combination screen and storm door having an inner core construction and having a metal surface layer overlying said core at the outer and inner side of said door, said door having a screen and window opening therein, one of said surface layers comprising a plurality of pieces arranged and assembled to have abutting edges in forming an outer skin layer for said door, said pieces forming seams at their abutting edges, said layer having an outward and an inward side, an adhesively applied tape overlying each of said seams on the inward side of said layer, and said tape being arranged and constructed to secure said pieces together into an integral layer and to cause said seams to be sealed against the penetration by elements of weather.

2. The structure of claim 1, wherein said one of said layers consisting of a base panel, a top panel and a pair of side strips joining said panels.

3. The structure of claim 1, wherein a perimeter channel member secures said outer layer to the core member of said door.

4. The structure of claim 1, wherein said pieces are particularly arranged to have abutting edges formed to be at points of least width.

* * * * *